United States Patent [19]

Rosenwinkel

[11] Patent Number: 4,664,547

[45] Date of Patent: May 12, 1987

[54] PRODUCT STORAGE CONTAINER AND DISPENSER

[75] Inventor: Karen W. Rosenwinkel, Oak Park, Ill.

[73] Assignee: W. Braun Company, Chicago, Ill.

[21] Appl. No.: 750,582

[22] Filed: Jul. 1, 1985

[51] Int. Cl.[4] ..... B41J 1/56

[52] U.S. Cl. ..... 401/175; 401/87; 401/171; 401/172

[58] Field of Search ..... 401/68, 73, 75, 174, 401/175, 172, 78, 87, 171; 222/390

[56] References Cited

U.S. PATENT DOCUMENTS

| | | | |
|---|---|---|---|
| 3,359,992 | 12/1967 | Cishek et al. | 401/171 X |
| 4,298,036 | 11/1981 | Horvath | 401/55 |
| 4,369,158 | 1/1983 | Woodruff et al. | 401/175 |
| 4,369,560 | 12/1982 | Gentile | 401/68 |
| 4,521,127 | 6/1985 | Tomburo et al. | 401/68 |
| 4,545,696 | 10/1985 | Carluccio | 401/75 X |
| 4,580,920 | 4/1986 | Schmidt | 401/75 X |

FOREIGN PATENT DOCUMENTS

| | | | |
|---|---|---|---|
| 3118893 | 11/1982 | Fed. Rep. of Germany | 401/68 |
| 916524 | 12/1946 | France | 401/171 |

*Primary Examiner*—Richard J. Apley
*Assistant Examiner*—Robert W. Bahr
*Attorney, Agent, or Firm*—Michael G. Berkman

[57] ABSTRACT

A container for storing, dispensing and applying solid and semi-solid materials, and being fillable, optionally, from the top or from the bottom. The container assembly is characterized by improved seals between a product supporting and elevating platform and the circumscribing body of the container and by simple yet highly effective bottom closure interlocks, seals, and vents rendering feasible the filling of the container conveniently from the bottom as well as from the top.

25 Claims, 17 Drawing Figures

94
112
60
114
100
98
72
120
74
70
88
78
82
62
90
84
52
54
50

72
88
94
84
78

26
114
72
60

216
290
36
180
294

PRODUCT STORAGE CONTAINER AND DISPENSER

BACKGROUND OF THE INVENTION

The present invention relates to containers useful as storage containers and as dispensers and applicators for soft and semi-hard products such as deodorant and anti-perspirant compositions, cologne, perfume sticks and other cosmetic preparations. More particularly, the invention is directed to a non-circular tubular container which includes a product elevating and retracting mechanism and is conveniently filled either from the top or from the bottom.

Many of the prior art container and applicator structures of the type having general utility in the area in which the present invention is useful are the type in which the tubular container is filled from the top or through the mouth of the container. Such top-filling processes have certain inefficiencies and are objectionable in that the final level of the upper surface of the filled product is not exactly controllable and that the surface contour itself is subject to roughness, irregularities, or uneven shapes in the area of ultimate application. Additionally, during the cooling process, the body of the filled material may contract producing an objectionable, concavity in the upper or applicator surface. Such a concavity impairs the utilitarian features of the applicator and adversely affects the aesthetic appearance.

Another objectionable feature of prior art cosmetic dispensers of the type including a product elevating and retracting mechanism is providing an effective seal between the product supporting and elevating platform and the circumscribing wall of the tubular container. For example, in order to facilitate the ease of upward and retracting displacement of the product it has been a common practice to form the container walls with a substantial flair or taper, thus producing an objectionable gap between the product and the inner container walls, resulting in excessive exposure of the product to solvent evaporation and other deleterious effects due to excessive contact with ambient air.

In those prior art containers and dispensers which may be filled from the bottom, the bottom closure and sealing mechanisms have not proven totally satisfactory in establishing air tight seals. Nor have there been adequate controls to ensure optimum positioning of the terminal, applicator end of the composition filling the body of the container. It is, accordingly, a principal aim of the present invention to obviate many of the shortcomings of the prior art applicators of the type described and to provide a simple yet highly effective structure characterized by improved bottom and top closures and seals, enhanced ease of elevating and retracting the product stored in the container, and an improved seal between the elevator platform of the product and the circumscribing wall of the container itself.

SUMMARY OF THE INVENTION

The product storage and dispensing container of the invention includes a tubular, open-ended body which is provided with end closures making it feasible to fill the container, optionally, from the top or from the bottom. It is a feature of the invention that the bottom closure or bottom sealing plug of the container and the base of the container are provided with snap-in coupling elements or interlocks which establish a positive mechanical interengagement and preclude inadvertent displacement of the bottom closure from the body of the container, once the closure has been telescopically coupled with the tubular container and snapped into place.

A related feature of the invention is that the bottom closure element serves additionally to retain in place the mechanism by which a product elevating platform of the invention is moved upwardly and downwardly through actuation of a threaded spindle or shaft.

Yet another feature of the invention is that there is provided a dish-like or trough-like product elevator platform which includes, in combination, sealing means for engaging an annular flange or sealing ring carried by the product elevating shaft, at its base.

It is an important feature of the closure and product elevating components of the invention that they include cooperating and interengaging lug-like posts and diminutive arcuate walls which preclude pivotal shifting of the product elevating platform with respect to the circumscribing wall of the container, thus preventing the establishment of objectionable increased frictional forces between the product elevating platform and the circumscribing wall of the container body.

A related feature of the invention is that the elevator platform or product supporting cup of the invention defines a structural configuration which establishes an annular line contact which defines a sealing ring and slide bearing with respect to the abutting inner face of the internal wall of the container body.

A feature of the bottom closure mechanism of the container, facilitating the bottom filling of the container, is that venting means are provided to facilitate the insertion of the product elevating and the container closing components after the composition has been poured into the container supported in an inverted mode. This important improvement allows ready escape of the contained air in the container body as the latter is filled and the closure assembly is forcibly inserted in place.

It is an important feature of the closure elements for the upper end of the container of the invention that there is provided a closure disc which surmounts the top edge of the container body and is retained in place by an offset shoulder formed in the circumscribing wall of the closure cap which telescopically overlies and sealingly engages the peripheral face of the container body at an upper circumscribing sector thereof.

A related feature of the invention is that the closure cap which surmounts the open top end of the container is provided with an array of vertically extending ribs directed radially inwardly and integrally formed with the sidewall of the cap on an inner wall face thereof, the ribs projecting downwardly along a partial height of the cap and presented their lower ends abuttingly to engage the closure disc of the container at an annular periphery of the disc to secure the disc firmly in place so that the disc constitutes a stablized "bottom" or floor when the container is inverted and filled from the bottom end.

It is a feature of the container of the invention that in a preferred embodiment the container body is non-circular in transverse section, and is preferably oval.

Other and further objects, and features and advantages of the invention will become evident from a reading of the following description considered in conjunction with the drawings.

BRIEF DESCRIPTION OF THE DRAWINGS

The following drawings in which like components and parts are designated by like numerals, provide a means for enhancing the understanding of the invention as described more fully in the specification set forth below.

DETAILED DESCRIPTION OF PREFERRED EMBODIMENTS

In effectuating the aims and purposes of the present invention, the structure of the product dispenser and applicator embodies principal components including a tubular container, a product supporting and elevating platform, a snap-in bottom closure or plug, a rotatable threaded shaft or spindle for raising and lowering the product support platform, a sealing disc surmounting the top edge of the tubular container, and a telescopically coupled cap for the container. In a preferred embodiment of the invention, the components are fabricated of plastic, for example polypropylene for the more rigid components and polyethylene for the less rigid elements.

Figure 1:
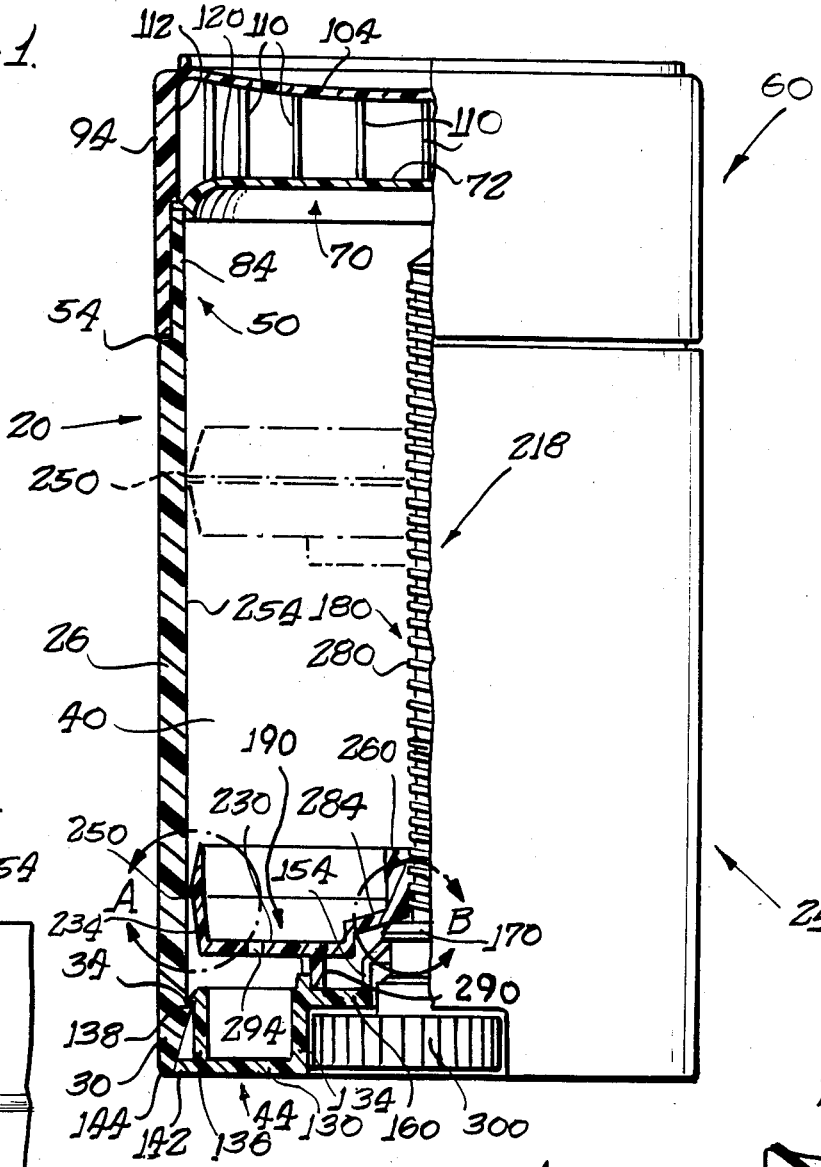
FIG. 1 is an elevational view, partly in vertical section, of a dispenser and applicator fillable in either normal or inverted position, according to the invention and embodying the features thereof, and showing the product supporting platform in an initial retracted mode and in an elevated mode (in phantom)
Figure 1A:
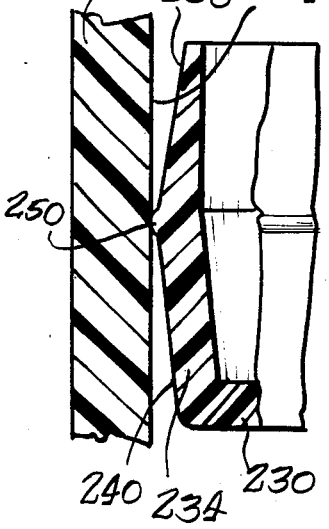
FIG. 1A is an enlarged view of that portion of the container encircled and designated "A" in FIG. 1, and showing an annular bead or line seal between the product supporting and elevating platform and the inside wall of the container body.
Figure 2:
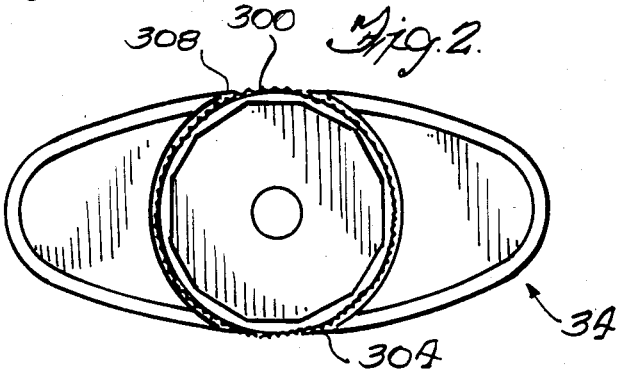
FIG. 2 is a bottom plan view of the container of FIG. 1.

Referring more particularly to the drawings, and specifically to FIG. 1, for purposes of disclosure and not in any limiting sense, one preferred embodiment of the product dispenser and applicator 20 of the invention is shown as a generally tubular container or body 24 open at each of opposed ends and generally oval in cross-section (FIG. 2). As shown in FIG. 1, the upstanding sidewall 26 of the container 24 is formed at a lower end section with a skirt 30 which is flared radially outwardly and downwardly from a radially inwardly directed annular step forming shoulder 34. The arrangement described provides an upwardly and inwardly tapering enlarged access opening 36 into the interior 40 of the container 24 facilitating the introduction of and securement of a closure plug assembly 44 as described in greater detail herebelow.

Also, in the preferred embodiment of the invention illustrated, the container body includes an upper zonal section 50 in which the container wall 26 is cut away 52 (FIG. 12) to provide an annular shoulder or stop 54, the cut away and shoulder serving to accomodate a top closure cap 60 for the container body or shell 24.

Figure 12:
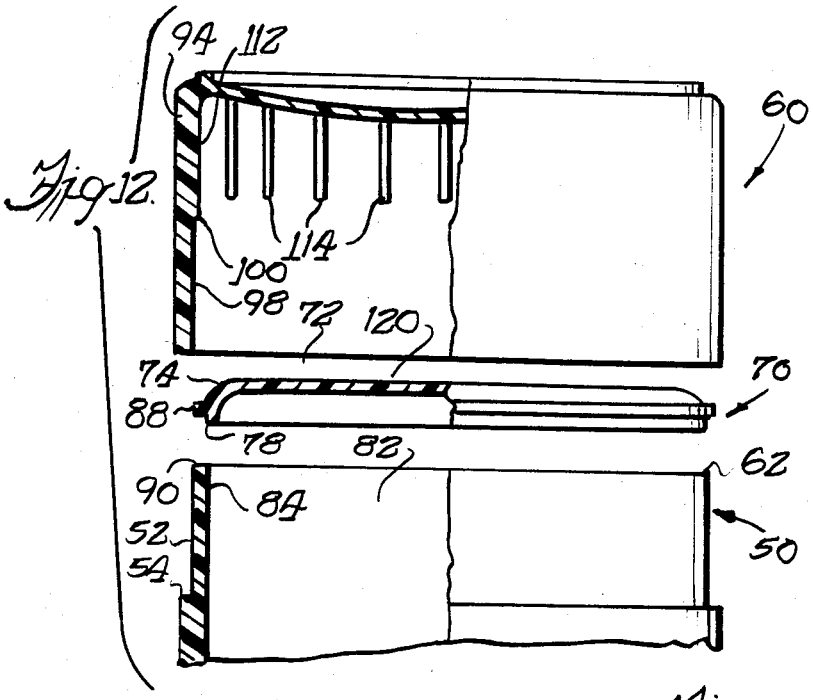
FIG. 12 is a fragmentary, exploded view, partly in section, and showing the upper end of the container, the top sealing disc, and the cap of the container.
Figure 13:
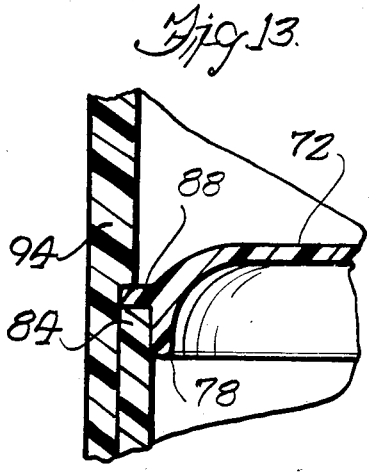
FIG. 13 is a fragmentary, enlarged, cross-sectional view showing the internesting and overlapping seal between the sealing disc and the top of the container, and the cap of the container securing the sealing disc in place and telescopically sealing with the body of the container.

As shown in FIGS. 1 and 12, the upper open end 62 is surmounted by a closure disc 70. The disc 70 includes a top wall 72 which is curved downwardly at its periphery 74 to define, at its end, a ring 78 which is sized externally to telescope within the opening 82 defined by the wall 84 at the upper open end of the container body. Extending radially outwardly from the disc 70 at its lower zonal sector is a flange 88 which overlies and seats upon a top edge 90 of the wall 84 of the container when the disc 70 is positioned in place, all as shown in FIG. 1.

The circumscribing wall 94 of the closure cap 60 is cut away 98 on an inner face (FIG. 12) to provide an annular shoulder 100 which extends radially inwardly to overlie and bear upon the radial flange 88 of the closure disc 70 when the latter is in its functional position in the assembly. As best seen in FIG. 1, the structure described results in the outer surface of the wall 94 of the closure cap 60 being flush with the outer surface of the container wall 26.

Figure 14:
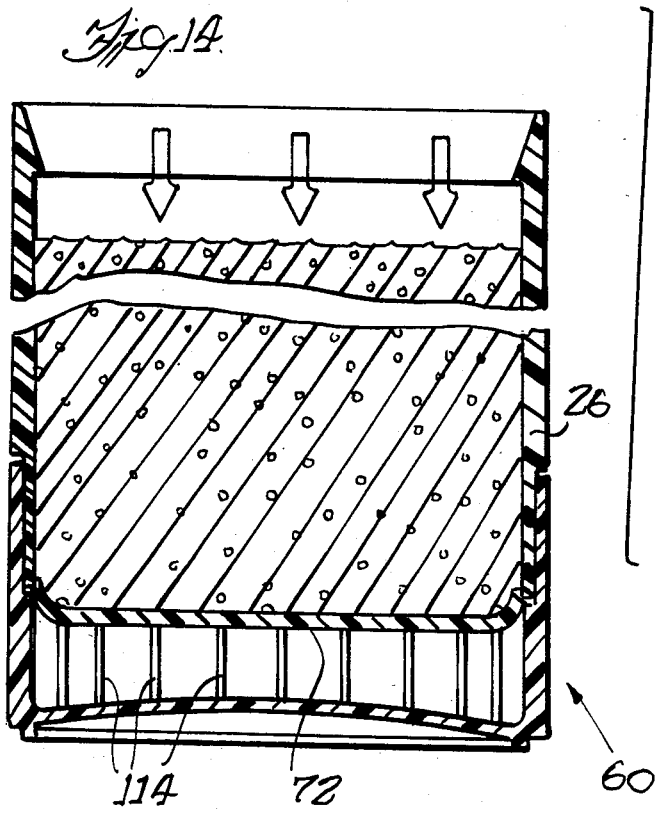
FIGS. 14 and 15 indicate schematically operative functions of components of the dispenser and applicator of the invention during bottom filling of the inverted container, the operation of the closure cap and the sealing disc being shown in FIG. 14, and the forced escape of air from the container through vent openings in the floor of the elevating platform during displacement by the filler composition and forced insertion of the bottom closure mechanism in place within the container base being indicated schematically in FIG. 15.
Figure 15:
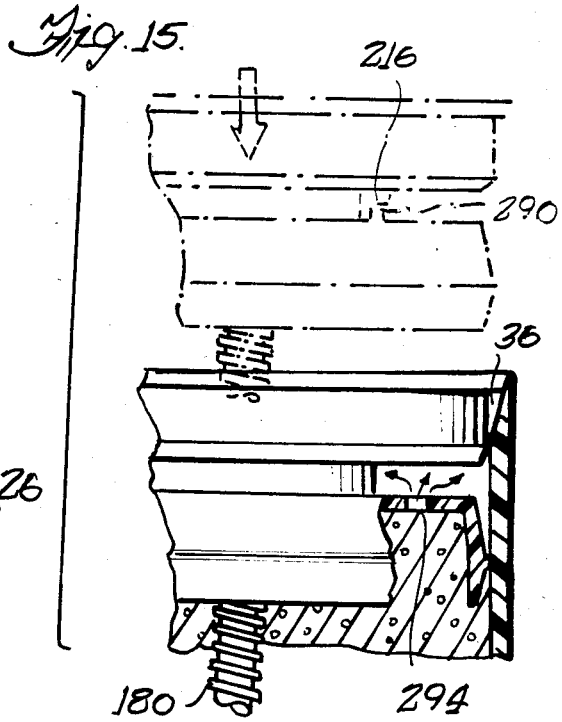

In the specific embodiment of the invention illustrated, the closure cap 60 includes a top wall 104 which is somewhat concave. An array of vertically extending ribs 110, radially inwardly directed, are integrally formed with the sidewall 94 of the closure cap 60 on an inner wall face 112 thereof. As shown in FIG. 1, the ribs 110 are spaced around the cap and project downwardly therewithin along a partial height of the cap so that the lower ends 114 of the ribs abuttingly engage and bear upon the top surface 120 of the closure disc 70, providing mechanical support for the disc 70 when the assembly is inverted and filled from the bottom (FIGS. 14 and 15).

The bottom closure or plug 44 is shown in position in FIG. 1, and details are illustrated in FIGS. 3, 4, 7, 8, and 9. As shown, the plug 44 includes a floor 130, inner and outer vertical walls 134 and 136 which, together with the floor 130 define an upwardly opening outer trough or dish. The outer wall 136 is formed at its upper end with a radially outwardly projecting bead or hook 138 which, as shown in FIG. 1, overlies and grippingly engages the radial flange 34 at the top of the skirt 30 of the sidewall 26 of the container 24.

The floor 130 of the closure plug 44 extends radially outwardly beyond the outer wall 136 to define a peripheral flange 140 which abuts, at its end 142 an inside terminal edge portion 144 of the skirt 30 of the body of the container 24. The arrangement described secures the closure plug within the bounding wall 26 of the container and imparts stability to the overall structure.

The closure plug 44 includes an integrally formed central core 150 having an upstanding circumscribing annular wall 154 connected to the inner wall 134 by a horizontal bridging wall 160. The wall 154 of the core 150 includes an upper ring section 164 angled inwardly and terminating in a rim 166 which abuts an underedge of a radially outwardly extending annular flange 170 carried by the threaded shaft assembly 180 which serves to elevate and retract the product supporting platform 190 of the invention.

In the preferred embodiment of the apparatus illustrated, the core 150 is formed with a plurality of vertically extending slots 200 spaced annularly about the circumscribing wall 154 of the core 150 to divide the core into a plurality of somewhat flexible and resilient fingers 206 the upper ends of which define the ring 166 which resiliently abuts and retains the spindle flange 170 and its associated drive shaft assembly 180 in place.

Figure 3:
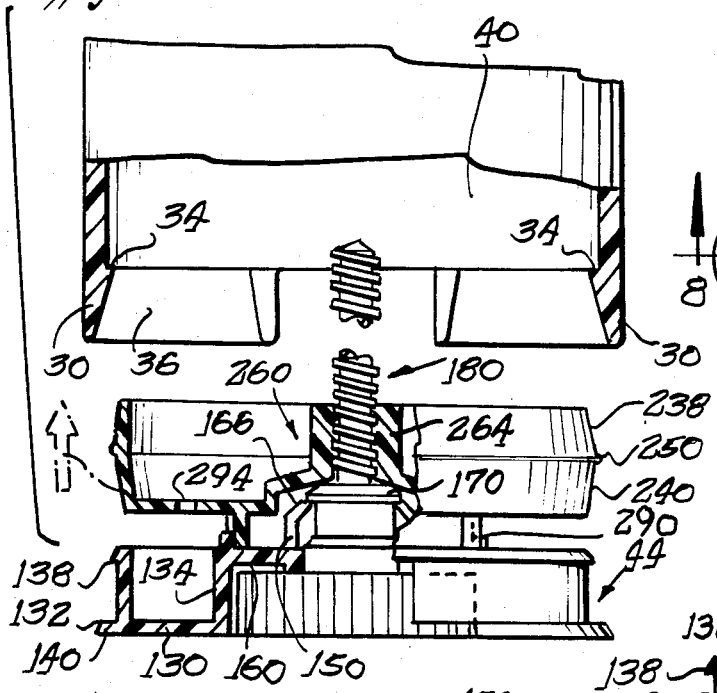
FIG. 3 is a fragmentary view, partly in section, and showing the container separated at its base from the threaded product elevating shaft, the product support platform, and the container closure plug.
Figure 7:
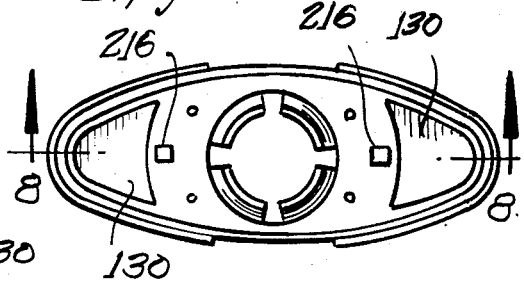
FIG. 7 is a top plan view of the bottom closure plug of the container.
Figure 8:
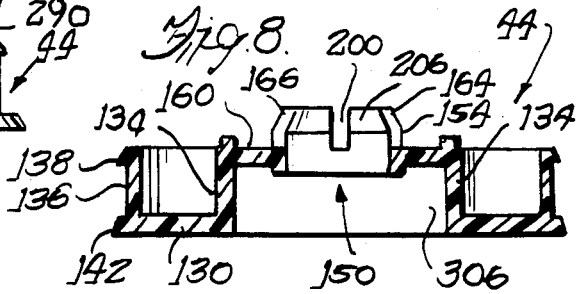
FIG. 8 is a cross-sectional view taken substantially on the line 8—8 of FIG. 7.
Figure 4:
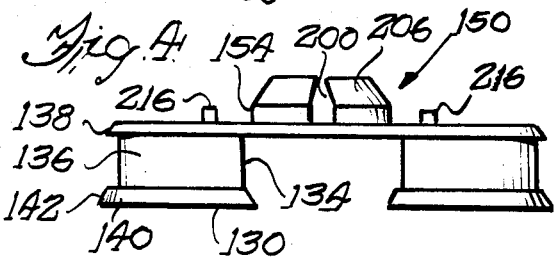
FIG. 4 is a side elevational view of the plug for closing the bottom opening in the container.
Figure 9:
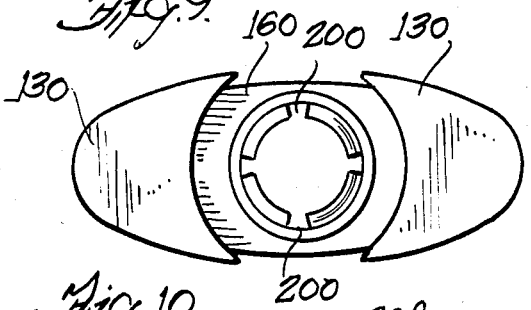
FIG. 9 is a bottom plan view of the closure plug of FIG. 4.
Figure 5:
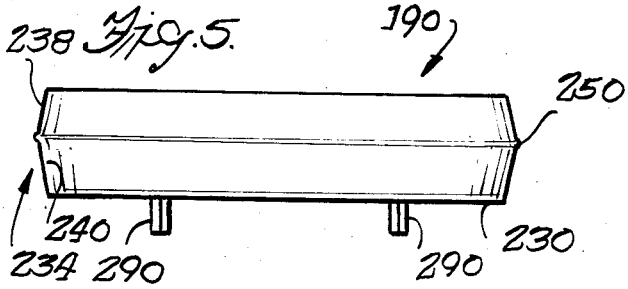
FIG. 5 is a side elevational view of the product supporting and elevating platform of the dispenser of the invention.
Figure 10:
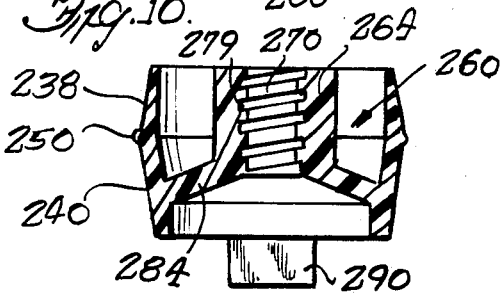
FIG. 10 is a cross-sectional view taken substantially on the line 10—10 of FIG. 6 and showing a threaded hub of the product elevator platform.
Figure 6:
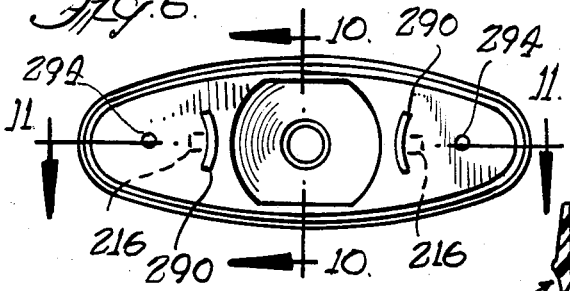
FIG. 6 is a bottom plan view of the platform of FIG. 5.
Figure 11:
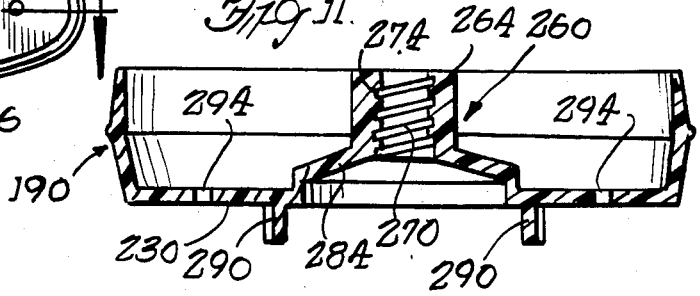
FIG. 11 is a cross-sectional view taken substantially on the line 11—11 of FIG. 6 and showing the wall seal, the threaded hub, and the pivot limiting walls of the product elevator.

As shown in FIGS. 1, 3, 4, 7 and 8, the closure plug 44 is provided at its upper wall 160 thereof with a pair of laterally-spaced, upwardly-extending lug-like posts 216 at either side of the central core 150 and on a principal horizonal axis of the oval shaped plug 44 (FIGS. 4, 7 and 8). That is, the posts 216 are positioned essentially on a major axis of the generally oval transverse plane of the container 20. The lugs 216 serve, with cooperating mechanical elements, to stabilize the product supporting platform 190 against rotational annular displacement during the application of elevating forces applied thereto through manipulation of the threaded elevator shaft 218, all as explained more fully hereinafter.

Referring now to the product elevator platform 190, and particularly to FIGS. 1, 3, 5, 6, 10 and 11, in the specific embodiment illustrated, the elevator platform 190 includes a floor 230 integrally formed with an upstanding circumferential wall 234, an outer face of the wall being tapered radially inwardly as viewed both upwardly 238 and downwardly 240 with respect to an intermediate annular locus defining a bead-like contacting element 250 which slidingly and sealingly abuts, in product-sealing contact an inner face 254 of the vertical wall 26 of the container 24.

The platform 190 also includes an integrally formed central, generally circular hub 260 having a generally cylindrical upstanding wall 264 defining an axially extending central opening 270. The wall 264 is threaded 274 interiorally to accomodate cooperating and interengaging threads 280 formed on the periphery of the threaded shaft 218 along the linear expanse thereof.

Figure 1B:
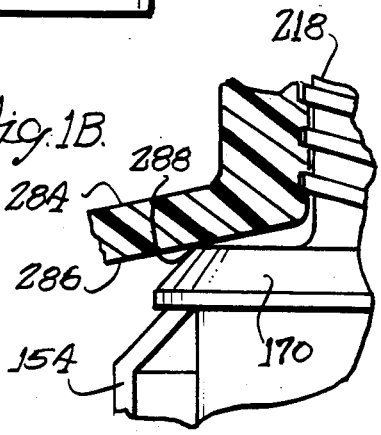
FIG. 1B is an enlarged view of that portion of the container encircled and designated "B" in FIG. 1, and showing the threaded interengagement between the internal hub of the platform and the threaded platform-elevating shaft, and a seal between the platform and a top edge of a flange encircling the product-elevating shaft.

Referring further to the product elevating and retracting platform 190, the central hub 260 is connected to the outer wall 234 by means of an intermediate annular wall 284 an undersurface of which 286 bears upon and sealingly engages an upper circumscribing annular edge 288 of the flange 170 at the base of the threaded portion 280 of the platform drive shaft 218, all as indicated schematically in FIG. 1B.

Referring further to the product elevating platform 190, and particularly to FIGS. 1, 3, 5, 6 and 11, the platform 190 is formed on an underside thereof with a pair of diminutive walls 290 of generally arcuate configuration and extending downwardly from the floor 230 of the platform at either side of the central hub 260 of the platform, the walls 290 being, as indicated schematically in FIGS. 3, in cooperating, laterally-adjacent registry with the posts 216 of the closure plug 44, establishing substantial abutting lateral contact of each of the posts 216 with a corresponding each of the walls 290, along a side surface of the walls. As indicated schematically in FIG. 6, the walls 290 are arced in a mode so as partially to encircle the respective posts 216. The described physical structure in which the walls 290 are in firm abutment with and restrained by the posts 216 serves to prevent pivotal shifting of the walls 290 with respect to the posts 216 and, thus, to prevent the platform 190 from shifting arcuately about a vertical axis of the container upon the application of rotational torque transmitted thereto through the drive shaft 218 during elevation and retraction of the platform 190.

Still another important feature of the product elevating platform 190 of the invention is that the floor 230 is formed with through ports 294 which serve as venting means to facilitate the escape of air from the body cavity of the container 24 during insertion of the platform 190 and the closure plug 150 upon having inverted the assembly and filled it from the bottom open end, as will be understood more fully upon consideration of the schematic representation depicted in FIGS. 14 and 15.

Referring now to FIGS. 1, 1B, 3, 10 and 11, the platform elevating assembly 180 is shown as including an elongated spindle or shaft 218 which is threaded 280 externally along substantially its entire length. At its lower end the shaft 218 terminates in a handwheel 300 which, in the assembled configuration of the apparatus is contained within a cooperating circular cavity 306 defined by the closure plug 44 in a central zone thereof. As indicated schematically in FIG. 2, digital access to and control of the knurled ring 300 is at each of the side faces 308 of the closure plug 44. In its functional mode, the threads 280 of the shaft 218 functionally engage the cooperating threads 274 of the hub 260 of the platform 190. As previously described, the sectors 206 of the closure plug 150 mechanically interengage and abut the flange 170 of the drive assembly 180 and prevent inadvertent withdrawal of the shaft 218 from the container 24 (FIGS. 1 and 3).

As previously pointed out, it is a feature of the apparatus of the subject invention that the container may be filled, optionally, from either the top or from the bottom. When filling from the top, it is necessary merely to remove the cap 60 and the sealing disc 70 and then to pour the filler material into the top open end of the container 24, the elevator platform 190 and the closure plug 44 being in the position illustrated in FIG. 1. After filling it is necessary merely to position the sealing disc 70 in place the telescopically to position the cap 60, all as indicated schematically in FIG. 1.

If the final appearance of the top surface of the product is not considered critical the package of the invention may be used without the sealing disc 70. In a top filling mode the top surface of the poured product will take the shape of a miniscus.

When it is desired to fill from the bottom of the assembly, the steps include positioning the sealing disc 70 and the cap 60 in place (as shown in FIG. 1). With the elevating platform 190, the bottom closure or plug assembly 44 and the threaded drive assembly 180 removed from the container, the container is inverted as indicated schematically in FIG. 14.

The large, unobstructed bottom opening permits ready positioning of a machine filling tube of a large diameter, facilitating a very rapid fill. The filler material is poured into the open (bottom) end of the container. Once the filling has been completed to the desired level, it is necessary merely axially to insert into the open bottom end of the container 24, preferably as an intercoupled unitary assembly, the elevating platform, the threaded drive assembly 180 and the closure plug 44, as indicated schematically in FIG. 15. During the final completion of the insertion, air contained in the assembly will escape through the ports 294 established in the floor 230 of the elevating platform 190, for that purpose. When fully inserted in position, the closure plug 44 will snap into place over the flange 34 of the skirt 30 of the container, as indicated in FIGS. 1 and 15.

Bascially, the unique and versatile structure of the present dispenser provides three distinct filling options: (1) top fill; (2) top fill, followed by inversion; and (3) bottom fill. The bottom fill method should be reserved for those products which have a relatively low evaporation rate (because of the vent holes 294 in the floor 230 of the elevating platform 190). The disc 70 in conjunction with the capability of filling from either the top or the bottom of the apparatus of the invention also affords the manufacturing filler important economy in handling the finished product. The need for packing delays or holdup is eliminated. Since, in accordance with the invention, the product is enclosed—top and bottom—the still hot filled container can be placed in its shipping carton or packet (either in an upright or in a reversed mode) and allowed to cool and solidify at its own rate, without any requirement for a special holding station. Important savings in time and in space demands are realized.

The provision of and the arrangement of structural elements of the dispenser of the invention obviate not only the need for costly cooling equipment on the assembly line, but also any need to trim or shape the stick product in order to achieve a desirable finished appearance. The package of the invention, with its special top disc 70 and with its bottom fill option and capabilities provides more latitude in filling techniques. For example, those manufacturers who do not have cooling facilitates and do not have trimming or shaping equipment will still be able to fill and market various products of the general type for which apparatus of the present type is adapted.

The foregoing description and drawings are provided to illustrate a preferred embodiment of the invention and are intended merely to exemplify the invention in one of its operative modes. It will be appreciated that one skilled in the art will readily recognize many variations and alterations which may be made without the exercise of the inventive faculty. All such variations and alterations are deemed to be within the spirit and scope of the present invention as defined in the appended claims.

What is claimed is:

1. A container for storing, dispensing and applying solid and semi-solid products, said container having a tubular, open-ended body and being readily fillable, optionally from the top or from the bottom, said body including an unrestrictedly open lower end section defining a skirt, said skirt defining at a lower end thereof an enlarged, unobstructed opening prividing free access to said body of said container for slidingly and telescopically introducing a product-supporting platform therewithin and for inserting a body closure thereinto, a plunger-like, generally trough-shaped, product-supporting platform spanning said container and being in stressing contiguous engagement with said tubular body interiorly thereof, said platform being forceably insertable through said unobstructed opening of said body through said completely open, skirt-defining end section thereof after filling said container from a bottom, unobstructed opening in said body of said container, said platform being formed with a floor and with a bounding upstanding circumferential wall, an outer circumscribing face of said circumferential wall being tapered radially inwardly upwardly, and being tapered radially inwardly downwardly with respect to an annular locus intermediate upper and lower limits of said wall to define upwardly and downwardly shiftable, low-friction, product-stabilizing, and container-sealing horizontally disposed, container-body-stressing rib means for facilitating forced telescopic insertion of said platform axially into said container from said open lower end section thereof without destroying and without impairing integrity of a stressing seal provided by said rib means with said container, interiorly thereof, said rib means being effective, upon forceably urging said platform slidably through said skirt, for preserving a compression seal between said platform and a circumscribing, abutting, bounding wall of said container at an inner surface thereof to prevent product in said container from invading a special zone below said platform, and a closure plug for insertion into said open lower end section of said body of said container as a closure therefor for retaining a product stored in said container and to be dispensed therefrom at an end thereof opposed to said closure plug.

2. The structure as set forth in claim 1 wherein said closure plug means is telescopically disposed within said body of said container and wherein said container comprises a unitary tube devoid of structural components extending lineally beyond a lower terminus of said body, said body defining an elongated, circumscribing wall uninterrupted between an upper end thereof and a lower limit of said container.

3. The structure as set forth in claim 1 wherein said tubular body of said container is free of structures integral therewith and having a configuration effective to prevent insertion of said platform into said body of said container from a lower open end thereof.

4. The structure as set forth in claim 1 and further comprising vent holes formed in to extend transversely through a base of said platform for venting gases displaced from an interior zone of said container pursuant ot optional bottom filling thereof, thereby to facilitate insertion of said platform into said body upon completion of filling of said container.

5. The structure as set forth in claim 1 and further comprising a closure cap adapted to telescope over an upper end of said container, said cap comprising a top wall and a circumscribing depending side wall, an inside surface of said side wall establishing essentially contiguous sealing abutment with a corresponding bounding annular section of an upper end zone of said container upon slideingly telescopingly positioning said cap in a superimposed mode to overlie and close an open top end of said container.

6. The structure as set forth in claim 5 and further comprising a closure disc surmounting an open top end of said container, elongated, vertically-extending, radially inwardly directed ribs integrally formed with said side wall of said cap on an inner wall face thereof, said ribs being spaced around said cap and projecting downwardly therewithin along a partial height of said cap, said ribs having downwardly directed lower ends for abuttingly engaging said closure disc of said container at an annular periphery of said disc for securing said disc in place as a seal and also as a floor-like base for supporting product during inversion of said container and filling of product into said container from the bottom thereof.

7. The structure as set forth in claim 6 wherein the bounding section of said upper zone of said container is reduced radially on an outer dimension thereof in an amount corresponding essentially to a thickness dimension of an overlying said side wall of said cap, an outer surface of said cap delineating a flush extension of an outer surface of said container extending therebelow when said cap is positioned telescopically onto said container at an upper open end thereof.

8. The structure as set forth in claim 7 wherein said side wall of said cap is stepped radially inwardly at an upper zonal section threof on an inner face thereof to provide an annular abutment shoulder constituting stop means for limiting penetration of said body of said container into said cap.

9. The structure as set forth in claim 6 wherein said closure disc spanning said cap interiorally thereof and sealing an upper open end of said container is maintained in sealing position by pressure derived through abutment with lower terminals of said ribs.

10. The structure as set forth in claim 9 and further comprising dual sealing means integrally formed with said closure disc in a circumscribing peripheral annular zone thereof, said sealing means including a radially outwardly extending flange of said disc for abutment sealing with a top end face of said container, and a downwardly projecting bounding wall of said disc for contiguous contact sealing engagement with said container interiorally thereof at an upper open end of said container.

11. The structure as set forth in claim 1 and further comprising a removable closure disc spanning said container at a top of said open-ended body, and wherein said container is fillable, optionally, from the top and from the bottom end thereof, and wherein said platform includes a central, generally-circular hub having a cylindrical wall defining an axially-extending central opening, and wherein said wall of said hub is threaded interiorally thereof, a drive shaft extending through said opening in said hub and generally coaxially with said body of said container, said drive shaft being formed exteriorally along a lineal expanse thereof with threads for matingly engaging with threads of said wall of said hub for drivingly elevating and retracting said platform and a product carried thereby, upon rotation of said shaft, drive means and means connecting said drive means to said shaft adjacent a lower end thereof for rotating said shaft, and wherein said plug means is insertable, selectively, prior to and after the filling of a product into said container.

12. The structure as set forth in claim 11 wherein said closure plug defines a cavity opening into a central base portion of said container, said cavity having a narrowed upper end bounded by said hub, an intermediate zone therebelow, and an enlarged entry recess, and wherein said drive means for said shaft comprises a shaft-actuating rotatable wheel housed in said entry recess of said cavity, and means drivingly connecting said wheel to said shaft for manipulative rotation of said shaft to effect, through mating threads of said shaft and said hub, elevation and retraction of said platform and of a product carried thereby.

13. The structure as set forth in claim 11 closure wherein said plug defines an upwardly opening outer trough having inner and outer circumambient vertical walls, a floor bridging therebetween, and an open, upstanding, central core having a circumscribing annular wall, a horizontally extending web connecting and bridging said outer trough and said wall of said core between a lower edge of said annular wall of said core and an upper edge of said inner wall of said outer trough, said annular wall of said core including wall means connected to and extending radially inwardly for engaging said drive shaft to prevent inadvertent withdrawal of said shaft downwardly from said container, and coupling for interlocking said closure plug means with said container at said skirt thereof for preventing inadvertent separation of said closure plug from said body of said container.

14. The structure as set forth in claim 13 and further comprising a peripheral flange integrally formed with said closure plug and projecting radially outwardly of said floor of said outer trough as a lateral extension thereof for contacting abutment with an inside terminal edge portion of said skirt of said body of said container for stablizing said closure plug against radial displacement within the body of said container.

15. The structure as set forth in claim 13 wherein said wall means for engaging said drive shaft includes an upper ring section angled inwardly and terminating in a rim abutting an under-edge of said radially outwardly extending annular flange carried by said shaft, said rim constituting with said flange an interlock serving to oppose inadvertent withdrawal displacement of said shaft downwardly from said container.

16. The structure as set forth in claim 13 wherein said skirt is flared outwardly downwardly and is formed at an upper end zone thereof with a circumscribing, annular, radially-inwardly-directed shoulder, and wherein said outer wall of said outer trough of said closure plug is formed with radially outwardly projecting annular rib means for overlying, interlocking engagement with said shoulder of said skirt of said container ot retain said closure plug in place within said container.

17. The structure as set forth in claim 13 and further comprising a pair of dimunitive walls of arcuate configuration and positioned laterally on either side of said hub of said platform, and projecting downwardly from said floor of said platform, a pair of laterally spaced, lug-like posts fastened to and extending upwardly from said web of said closure plug at either side of central core, said walls being in cooperating laterally adjacent registry with corresponding said posts to establish substantial abutting contact of each of said posts with a corresponding each of said walls along a side surface of said walls, said walls being arced in a mode so as partially to encircle respective said posts, said walls coming into firm abutment with, and being restrained by said posts upon relative rotation of said platform with respect to said closure plug, thereby to prevent privotal shifting of said walls with respect to said posts and prevent said platform from shifting acruately with respect to said closure plug, thereby to maintain a fixed annular orientation between said platform and said closure plug preparatory to insertion thereof into said lower open end of said body of said container.

18. The structure as set forth in claim 17 wherein said container is oval in cross-section and wherein said posts and said walls lie essentially on a major axis of a generally oval transverse plane of said container.

19. In a container for storing, dispensing and applying solid and semi-solid products, said container having a tubular, open-ended body and being readily fillable, optionally, from the top or from the bottom, said body being completely open at a lower end section thereof defining a skirt, said container having a lower closure, and said skirt having interlock means intergrally formed therewith for intercoupling locking engagement with said closure for said container, said skirt being flared radially outwardly and downwardly interiorly of said container to provide an upwardly and inwardly tapering, enlarged, unobstructed access opening into said body of said container for slidably introducing a product-supporting platform thereinto and for insertion of a closure plug thereinto, a plunger-like, generally trough-shaped, product-supporting platform spanning said container interiorly thereof, said platform having a floor and an integrally-formed, upstanding circumferential wall, and being insertable from a bottom open end of said open-ended body through said completely-open end-section thereof after filling said container through the bottom thereof, the improvement wherein said wall is formed with an outer face thereof which is tapered radially inwardly upwardly and which is tapered radially inwardly downwardly with respect to an annular locus intermediate upper and lower limits of said wall to define an upwardly and downwardly shiftable, low-friction, product-stabilizing, container-stressing, and container-sealing rib means for facilitating forced telescopic insertion of said platform axially into said container from an open lower end section thereof without impairing or destroying the integrity of a container-stressing seal provided by said rib means, said rib means being resiliently deformable for permitting entry of said platform up through the open bottom end of said container and said rib means being effective for preserving a container-stressing seal between said platform and a bounding wall of said container at an inner surface thereof to prevent product in said container from invading a zone below said platform including during filling of said container from a top thereof.

20. The improvement as set forth in claim 19 wherein said lower closure is telescopically disposed entirely within said body, and wherein said body of said container comprises a unitary tube devoid of structural components extending lineally beyond a lower terminus of said body, said body defining an elongated, cicumscribing wall uninterrupted between an upper end thereof and a lower limit of said container.

21. The improvement as set forth in claim 19 wherein said platform includes an integrally-formed, central, generally circular hub having a cylindrical wall defining an axially extending central opening, said wall of said hub being threaded interiorly thereof, a drive shaft extending through said opening in said hub and generally coaxially with said body of said container, said drive shaft being formed exteriorly along the length thereof with threads for mating engagement with threads of said wall of said hub, for drivingly elevating and retracting said platform and a product carried thereby, upon rotation of said shaft, a stationary closure plug for insertion, selectively, prior to and after the filling of a product into said container, said closure plug being insertable into a lower end of said container either prior to or after filling as a closure therefor for retaining a product stored in said container, said closure plug defining an upwardly opening outer trough having inner and outer circumambient vertical walls, a floor bridging therebetween, and an open, upstanding central core having a circumscribing annular wall, a horizontally extending web connecting and bridging said outer trough and said wall of said core between a lower edge of said annular wall of said core and an upper edge of said inner wall of said outer trough, said annular wall of said core including wall means connected to and extending radially inwardly for engaging said drive shaft to prevent inadvertent withdrawal of said shaft downwardly from said container.

22. The improvement as set forth in claim 21 and further comprising a pair of dimunitive walls of arcuate configuration and positioned laterally on either side of said hub of said platform and projecting downwardly from said floor of said platform, a pair of laterally-spaced, lug-like posts fastened to and extending upwardly from said web of said closure plug at either side of said central core, said walls being in cooperating, laterally adjacent registry with corresponding said posts to establish substantial abutting contact of said posts with a corresponding each of said walls along a side surface of said walls, said walls being arced in a mode so as partially to encircle respective said posts, said walls coming into firm abutment with, and being restrained by said posts upon relative rotation of said platform with respect to said closure plug, thereby to prevent pivotal shifting of said walls with respect to said posts and to prevent said platform from shifting actuately with respect to said closure plug, thereby to maintain a fixed annular orientation between said platform and said closure plug preparatory to insertion thereof into said lower open end of said body of said container.

23. The improvement as set forth in claim 19 and further comprising a closure cap adapted to telescope over an upper end of said container, a removable closure disk surmounting an open top end of said container for retention within said cap during filling of said container through the bottom thereof.

24. The improvement as set forth in claim 23 and further comprising elongated, vertically-extending, radially inwardly directed ribs integrally formed with said side wall of said cap on an inner wall face thereof, said ribs being spaced around said cap and projecting downwardly therewithin along a partial height of said cap, said ribs having downwardly directed lower ends for abuttingly engaging said closure disk of said container at an annular periphery of said disk for securing said disk in place as a seal and also as a floor-like base for supporting product during inversion of said container and filling of product into said container from the bottom thereof.

25. The improvement as set forth in claim 24 wherein said closure disk spans said cap interiorly thereof and seals an upper open end of said container, said closure disk being maintained in sealing position by pressure derived through abutment with lower terminals of said ribs.

* * * * *